US005857217A

United States Patent [19]

Hsueh

[11] Patent Number: 5,857,217

[45] Date of Patent: Jan. 12, 1999

[54] LIGHT REFLECTION BAND DEVICE

[76] Inventor: Yu-Sheng Hsueh, 58, Ma Yuan West St., Taichung, Taiwan

[21] Appl. No.: 972,187

[22] Filed: Nov. 18, 1997

[51] Int. Cl.[6] ..... A41D 20/00; A44C 5/00; A63H 33/00

[52] U.S. Cl. ..... 2/170; 2/338; 63/21; 446/26; 446/267; 446/486; 368/282

[58] Field of Search ..... 2/170, 338, 224; 63/1.11, 12, 3, 5.2, 11, 21, 23; 446/26, 27, 28, 176, 267, 486, 487; 368/3, 276, 277, 278, 280, 281, 282, 285; D11/1, 3; D21/60, 144

[56] References Cited

U.S. PATENT DOCUMENTS

| | | |
|---|---|---|
| 2,462,425 | 2/1949 | Pratt et al. . |
| 2,703,087 | 3/1955 | Newmark . |
| 2,925,706 | 2/1960 | Morf . |
| 3,410,023 | 11/1968 | Anello . |
| 4,724,548 | 2/1988 | London . |
| 4,779,249 | 10/1988 | Rappaport . |
| 5,264,267 | 11/1993 | Wang . |
| 5,540,720 | 7/1996 | Ortega . |
| 5,622,293 | 4/1997 | LeFevre . |
| 5,740,623 | 4/1998 | Juhan et al. . |
| 5,782,107 | 7/1998 | Glanz . |

*Primary Examiner*—Michael A. Neas
*Assistant Examiner*—Shirra L. Jenkins

[57] ABSTRACT

A light-reflection band device has a protection band, a flexible plate disposed on the protection band, a base band disposed on the flexible plate, a transparent layer disposed on the base band, and a liquid solution and a large number of light-reflection particles disposed between the transparent layer and the base band. A periphery of the protection band, a periphery of the flexible plate, a periphery of the base band, and a periphery of the transparent layer are melted together.

4 Claims, 8 Drawing Sheets

LIGHT REFLECTION BAND DEVICE

BACKGROUND OF THE INVENTION

The present invention relates to a light-reflection band device. More particularly, the present invention relates to a light-reflection band device which can reflect light at night.

Conventional light-reflection clothes often have a plurality of buttons. In general, the conventional light-reflection clothes are too large. Therefore, it is not convenient for the users to wear the light-reflection clothes.

SUMMARY OF THE INVENTION

An object of the present invention is to provide a light-reflection band device which can reflect light at night.

Another object of the present invention is to provide a light-reflection band device which can be placed on a wrist or a waist of the user.

Accordingly, a light-reflection band device comprises a protection band, a flexible plate disposed on the protection band, a base band disposed on the flexible plate, a transparent layer disposed on the base band, and a liquid solution and a large number of light-reflection particles disposed between the transparent layer and the base band. A periphery of the protection band, a periphery of the flexible plate, a periphery of the base band, and a periphery of the transparent layer are melted together. The flexible plate has a groove formed on a face of the flexible plate and a ridge formed on an opposite face of the flexible plate. The function of the groove and the ridge is to prevent the flexible plate from winding while the flexible plate is bent. A decoration device is disposed on an end of the light-reflection band device. The decoration device comprises a decoration watch crystal, an hour hand and a minute hand disposed in the decoration watch crystal, a base seat, a first semicircular plate, a second semicircular plate, a first coiled spring, a second coiled spring, a pinion, and a gear. The base seat has a first rail, a second rail parallel to the first rail, a first post, a second post, a first aperture, a second aperture, and four corner holes. The first semicircular plate has a first semicircular flange, a first extension bar, a first round hole, and a second round hole. The first extension bar has a first extended slot and a plurality of first serrations. The second semicircular plate has a second semicircular flange, a second extension bar, a first circular hole, and a second circular hole. The second extension bar has a second extended slot and a plurality of second serrations. A first rivet fastens the gear via the second aperture. A second rivet fastens the pinion via the first aperture. The first post is inserted in the first extended slot. The second post is inserted in the second extended slot. The pinion is disposed between the first extension bar and the second extension bar. The pinion engages with the first serrations and the second serrations. The first coiled spring has a first hook end inserted in the second round hole and a second hook end inserted in the second circular hole. The second coiled spring has a first distal end inserted in the first round hole and a second distal end inserted in the first circular hole.

DETAILED DESCRIPTION OF THE INVENTION

Figure 1:
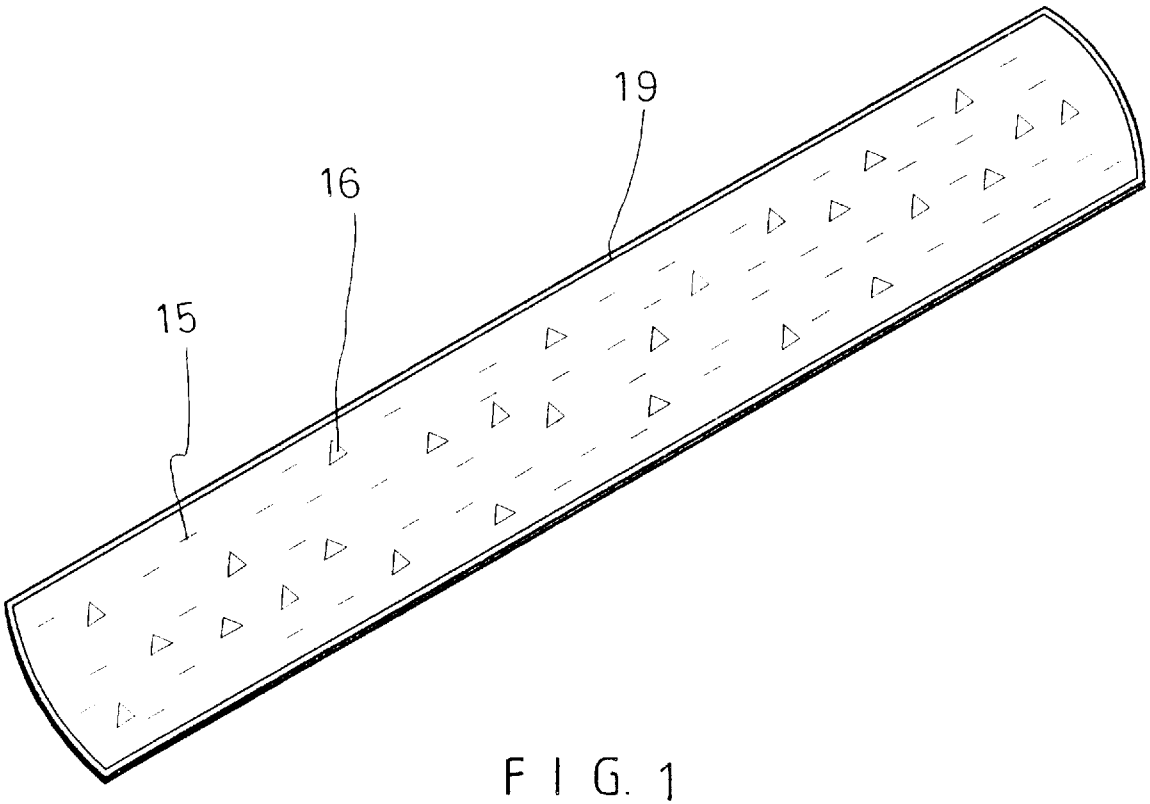
FIG. 1 is a perspective view of a light-reflection band device of a preferred embodiment in accordance with the present invention.
Figure 2:
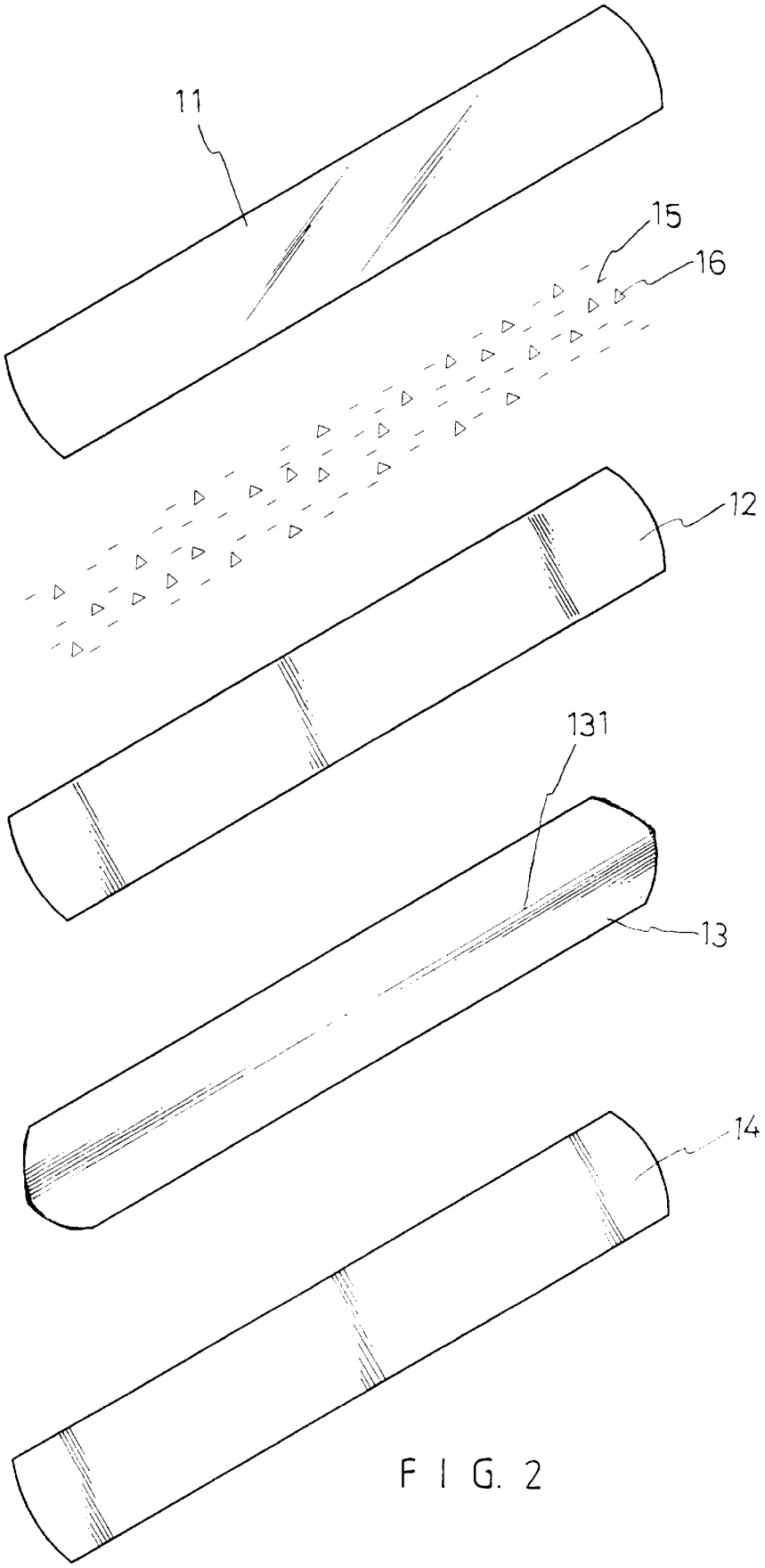
FIG. 2 is a perspective exploded view of a light-reflection band device of a preferred embodiment in accordance with the present invention.
Figure 4:
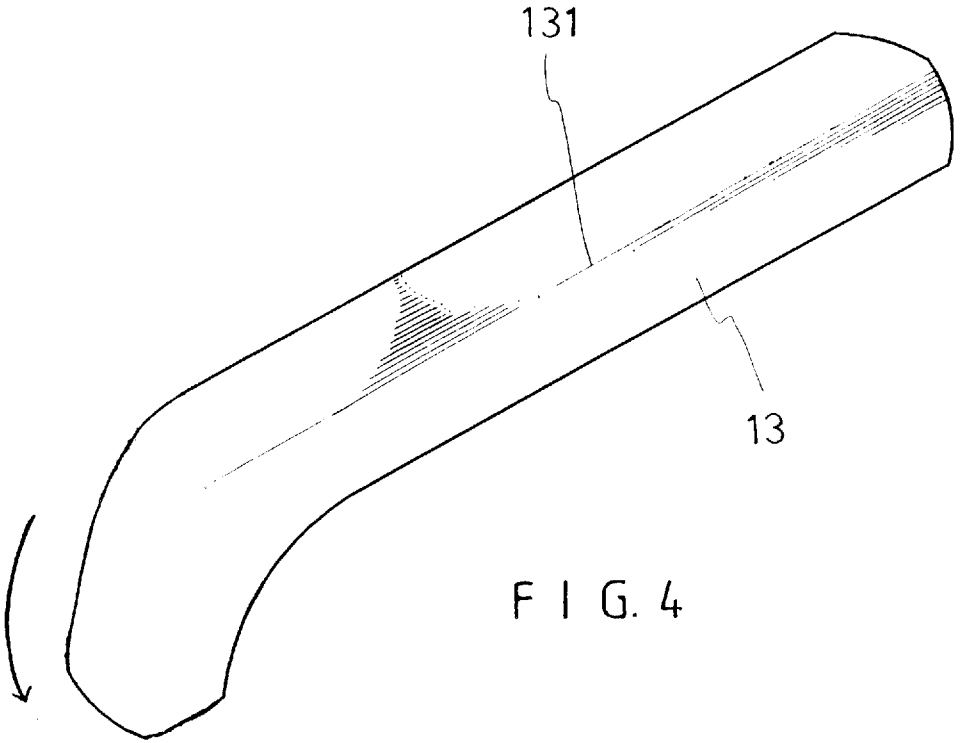
FIG. 4 is a schematic view of a flexible plate of a preferred embodiment while an end of the flexible plate is bent.
Figure 3:
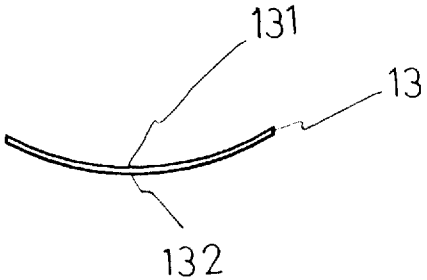
FIG. 3 is an elevational view of a flexible plate of a preferred embodiment while the flexible plate is bent.

Referring to FIGS. 1 to 4, a light-reflection band device comprises a protection band 14, a flexible plate 13 disposed on the protection band 14, a base band 12 disposed on the flexible plate 13, a transparent layer 11 disposed on the base band 12, and a liquid solution 15 and a large number of light-reflection particles 16 disposed between the transparent layer 11 and the base band 12. A periphery of the protection band 14, a periphery of the flexible plate 13, a periphery of the base band 12, and a periphery of the transparent layer 11 are melted together such as at 19.

Referring to FIGS. 3 and 4 again, the flexible plate 13 has a groove 131 formed on a face of the flexible plate 13 and a ridge 132 formed on an opposite face of the flexible plate 13. The function of the groove 131 and the ridge 132 is to prevent the flexible plate 13 from winding while the flexible plate 13 is bent.

Figure 6:
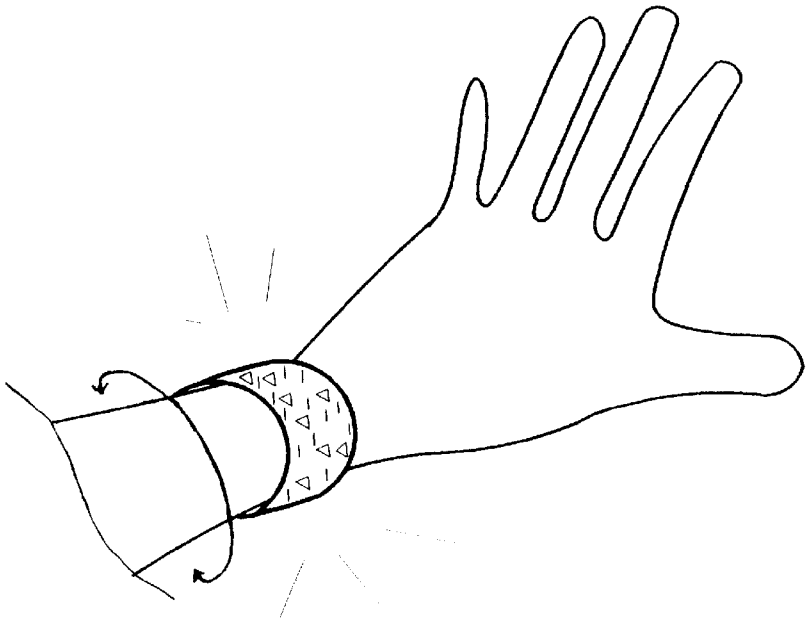
FIG. 6 is a schematic view of a light-reflection band device of a preferred embodiment while the light-reflection band device surrounding a wrist.
Figure 5:
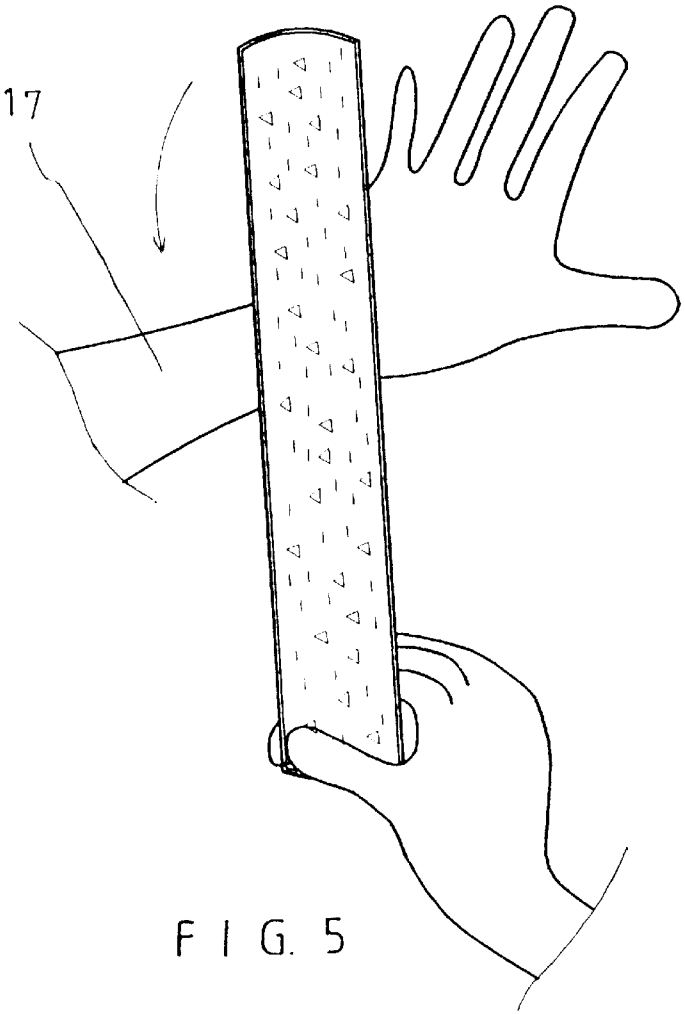
FIG. 5 is a schematic view of a light-reflection band device of a preferred embodiment before the light-reflection band device winds a wrist.

Referring to FIGS. 5 and 6, the light-reflection band device of the present invention can be used as a wristlet. The light-reflection band device surrounds the wrist 17. The user can bend one end of the light-reflection band device first, then the whole light-reflection band device is gradually bent.

Figure 6A:
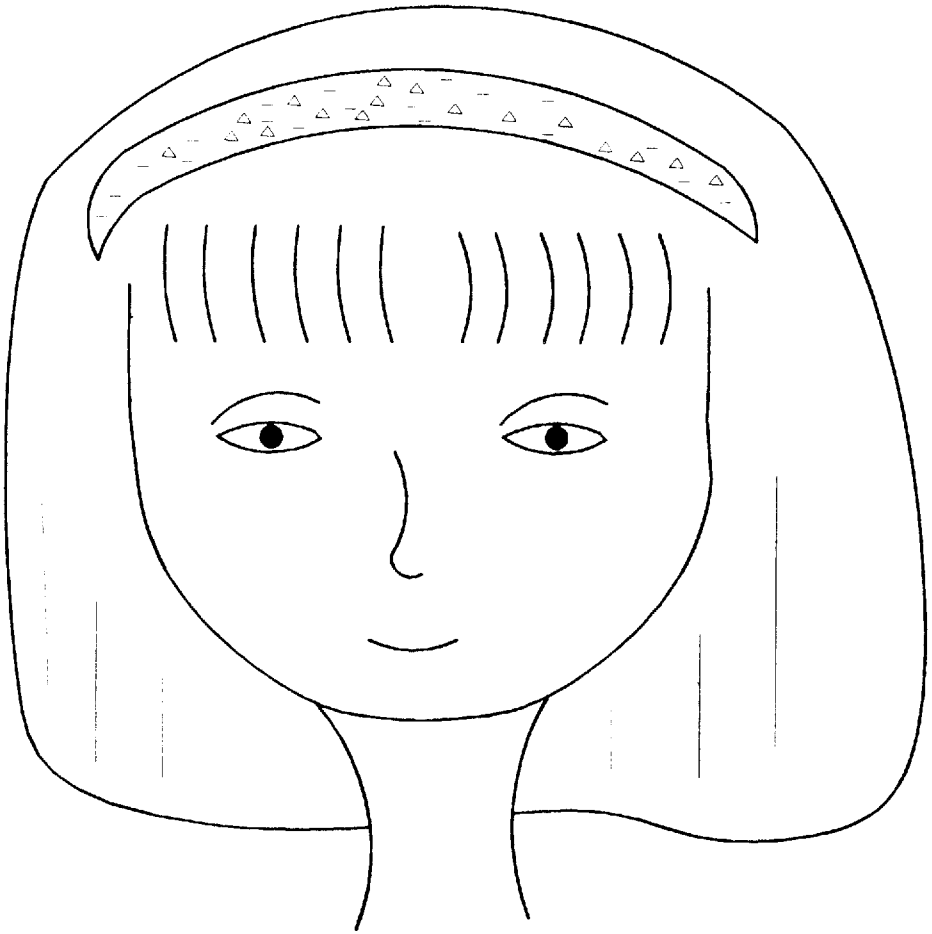
FIG. 6A is a schematic view of a light-reflection band device of a preferred embodiment while the light-reflection band device surrounding a head.

Referring to FIG. 6A, the light-reflection band device of the present invention can be used as a fillet. The light-reflection band device surrounds the head.

Figure 7:
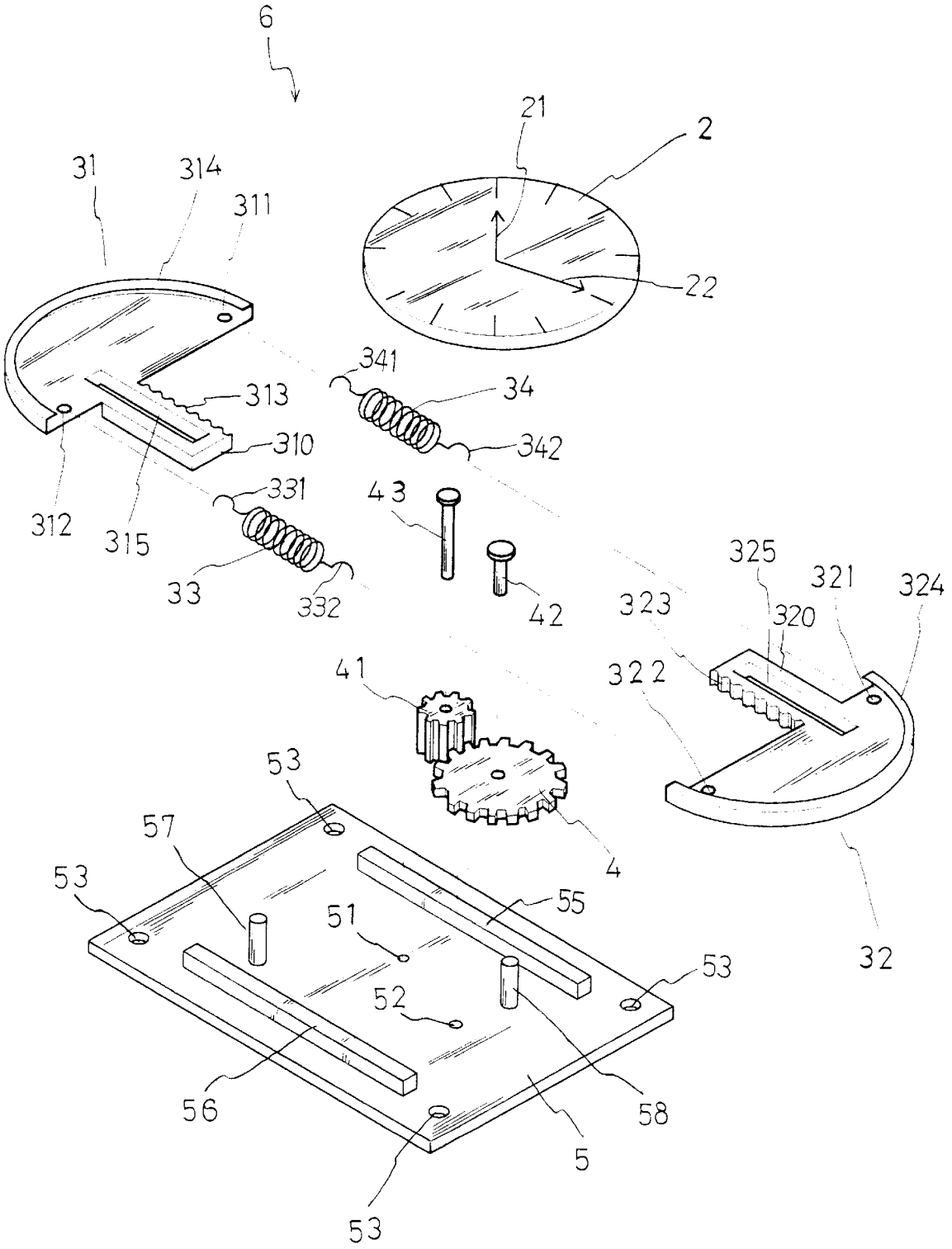
FIG. 7 is a perspective exploded view of a decoration device of a preferred embodiment in accordance with the present invention.
Figure 8:
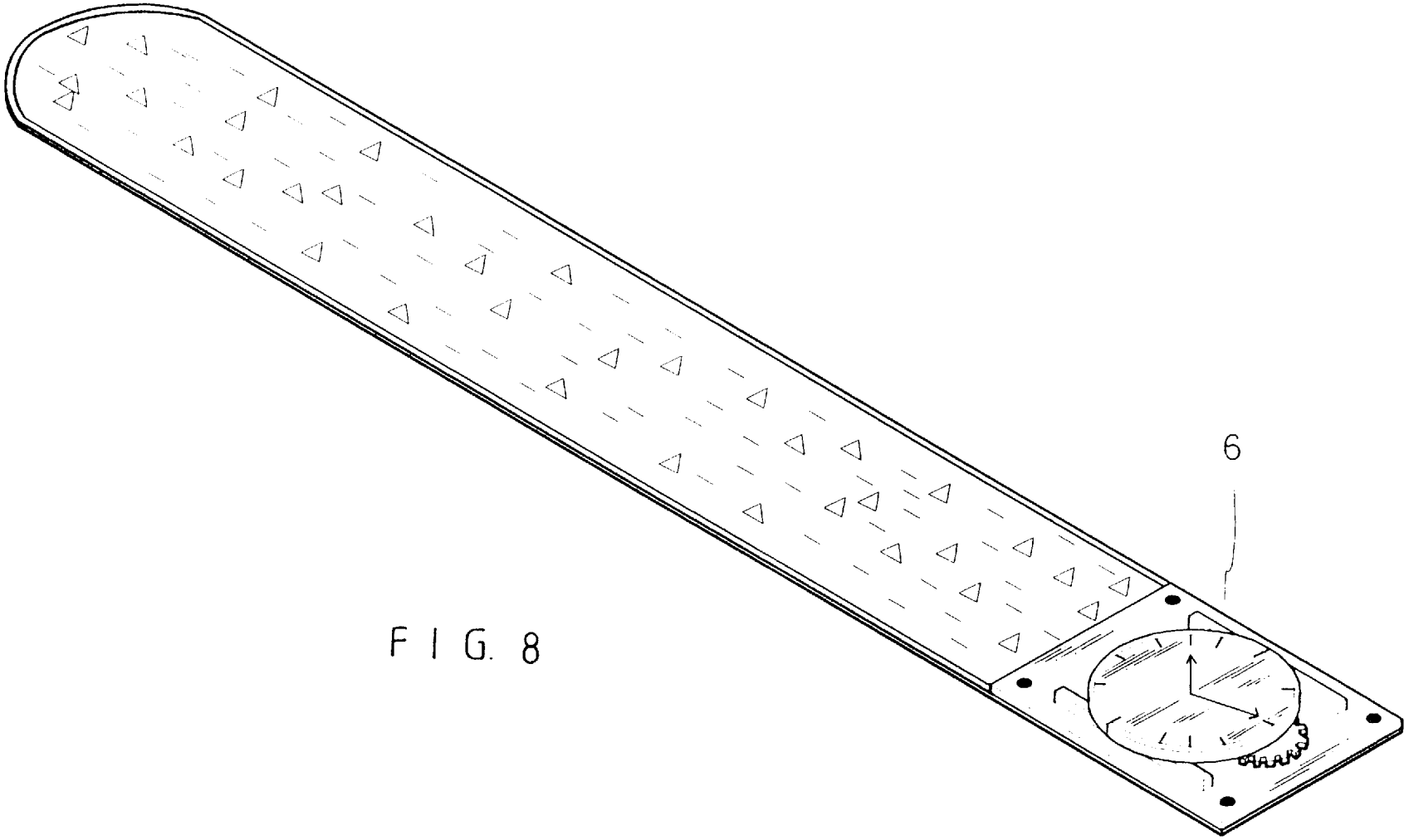
FIG. 8 is a perspective assembly view of a decoration device and a light-reflection band device of a preferred embodiment in accordance with the present invention.
Figure 9:
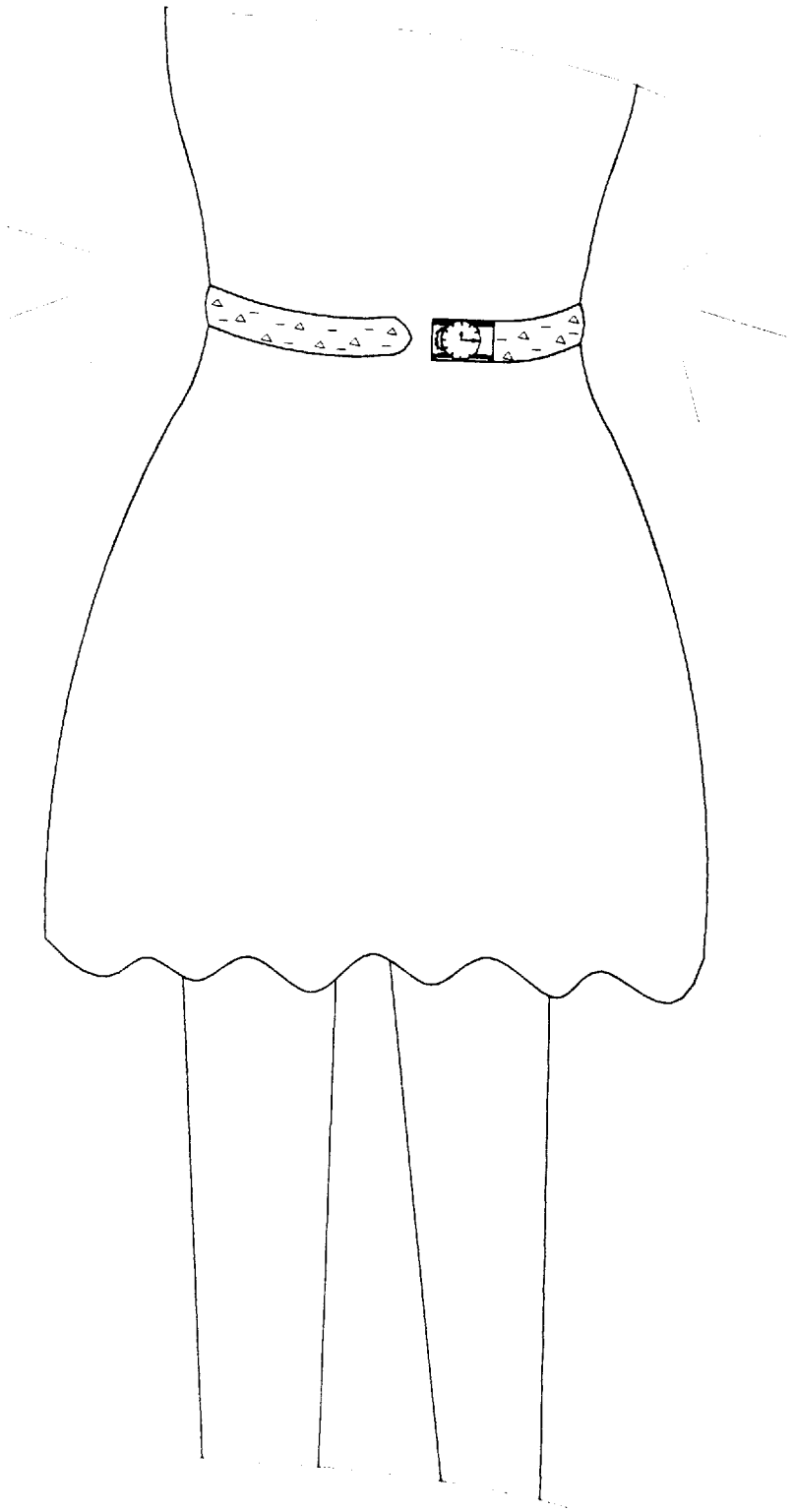
FIG. 9 is a schematic view illustrating a decoration device and a light-reflection band device surrounding a wrist.

Referring to FIGS. 7 to 9, a decoration device 6 is disposed on an end of the light-reflection band device. The decoration device 6 comprises a decoration watch crystal 2, an hour hand 21 and a minute hand 22 disposed in the decoration watch crystal 2, a base seat 5, a first semicircular plate 31, a second semicircular plate 32, a first coiled spring 33, a second coiled spring 34, a pinion 41, and a gear 4. The base seat 5 has a first rail 55, a second rail 56 parallel to the first rail 55, a first post 57, a second post 58, a first aperture 51, a second aperture 52, and four corner holes 53. The first semicircular plate 31 has a first semicircular flange 314, a first extension bar 310, a first round hole 311, and a second round hole 312. The first extension bar 310 has a first extended slot 315 and a plurality of first serrations 313. The second semicircular plate 32 has a second semicircular flange 324, a second extension bar 320, a first circular hole 321, and a second circular hole 322. The second extension bar 320 has a second extended slot 325 and a plurality of second serrations 323. A first rivet 42 fastens the gear 4 via the second aperture 52. A second rivet 43 fastens the pinion 41 via the first aperture 51. The first post 57 is inserted in the first extended slot 315. The second post 58 is inserted in the second extended slot 325. The pinion 41 is disposed between the first extension bar 310 and the second extension bar 320. The pinion 41 engages with the first serrations 313 and the second serrations 323. The first coiled spring 33 has a first hook end 331 inserted in the second round hole 312 and a second hook end 332 inserted in the second circular hole 322. The second coiled spring 34 has a first distal end 341 inserted in the first round hole 311 and a second distal end 342 inserted in the first circular hole 321. The decoration watch crystal 2 is confined between the first semicircular flange 314 and the second semicircular flange 314.

The present invention has the following advantages.

The light-reflection band device has a large number of light-reflection particles reflecting light at night. Therefore, the user can be seen by the other persons while walking at night.

The light-reflection band device can surround a wrist or a waist of the user.

The light-reflection band device can surround a head of the user also.

The invention is not limited to the above embodiment but various modification thereof may be made. Further, various changes in form and detail may be made without departing from the scope of the invention.

I claim:

1. A light-reflection band device comprises:

a protection band, a flexible plate disposed on the protection band, a base band disposed on the flexible plate, a transparent layer disposed on the base band, a liquid solution and a large number of light-reflection particles disposed between the transparent layer and the base band, and a periphery of the protection band, a periphery of the flexible plate, a periphery of the base band, and a periphery of the transparent layer melted together.

2. A light-reflection band device as claimed in claim 1, wherein the flexible plate has a groove formed on a face of the flexible plate and a ridge formed on an opposite face of the flexible plate.

3. A light-reflection band device as claimed in claim 1, wherein a decoration device is disposed on an end of the light-reflection band device.

4. A light-reflection band device as claimed in claim 3, wherein the decoration device comprises a decoration watch crystal, an hour hand and a minute hand disposed in the decoration watch crystal, a base seat, a first semicircular plate, a second semicircular plate, a first coiled spring, a second coiled spring, a pinion, and a gear, and wherein the base seat has a first rail, a second rail parallel to the first rail, a first post, a second post, a first aperture, a second aperture, and four corner holes, the first semicircular plate has a first semicircular flange, a first extension bar, a first round hole, and a second round hole, the first extension bar has a first extended slot and a plurality of first serrations, the second semicircular plate has a second semicircular flange, a second extension bar, a first circular hole, and a second circular hole, the second extension bar has a second extended slot and a plurality of second serrations, a first rivet fastens the gear via the second aperture, a second rivet fastens the pinion via the first aperture, the first post is inserted in the first extended slot, the second post is inserted in the second extended slot, the pinion is disposed between the first extension bar and the second extension bar, the pinion engages with the first serrations and the second serrations, the first coiled spring has a first hook end inserted in the second round hole and a second hook end inserted in the second circular hole, the second coiled spring has a first distal end inserted in the first round hole and a second distal end inserted in the first circular hole, and the decoration watch crystal is confined between the first semicircular flange and the second semicircular flange.

* * * * *